US005599658A

United States Patent [19]

Greener et al.

[11] Patent Number: 5,599,658

[45] Date of Patent: Feb. 4, 1997

[54] PHOTOGRAPHIC FILM-BASE AND PHOTOGRAPHIC ELEMENTS

[75] Inventors: Jehuda Greener; Wen-Li A. Chen, both of Rochester, N.Y.

[73] Assignee: Eastman Kodak Company, Rochester, N.Y.

[21] Appl. No.: 574,471

[22] Filed: Dec. 19, 1995

[51] Int. Cl.[6] ..... G03C 1/795

[52] U.S. Cl. ..... 430/533; 430/531; 525/432; 525/420; 525/425; 525/426

[58] Field of Search ..... 430/533, 531; 525/432, 420, 425, 436

[56] References Cited

U.S. PATENT DOCUMENTS

| | | | |
|---|---|---|---|
| 3,847,867 | 11/1974 | Heath et al. | 528/26 |
| 4,141,735 | 2/1979 | Schrader et al. | 430/141 |
| 4,141,927 | 2/1979 | White et al. | 525/432 |
| 5,288,601 | 2/1994 | Greener et al. | 430/533 |
| 5,294,473 | 3/1994 | Kawamoto | 428/141 |
| 5,368,997 | 11/1994 | Kawamoto | 430/533 |
| 5,538,841 | 7/1996 | Grace et al. | 430/533 |

OTHER PUBLICATIONS

Research Disclosure No. 28338, Nov. 1987, Kenneth Mason Publications, Ltd., Dudley House, 12 North Street, Emsworth, Hampshire p010 7DQ, England.

*Primary Examiner*—Mark F. Huff
*Attorney, Agent, or Firm*—Joshua G. Levitt

[57] ABSTRACT

A highly useful photographic film base comprises a miscible blend of poly(ethylene naphthalate) and a poly(ether imide) in specified proportions. Photographic elements prepared with this film base have a lesser tendency to take core-set and post process curl than do elements prepared with poly(ethylene naphthalate) film base.

9 Claims, No Drawings

PHOTOGRAPHIC FILM-BASE AND PHOTOGRAPHIC ELEMENTS

FIELD OF THE INVENTION

This invention relates to a novel photographic film base prepared from a novel blend of polymers and to photographic elements containing this film base.

BACKGROUND OF THE INVENTION

Silver halide color photographic elements comprise one or more light sensitive layers coated on a support. Typically the support is a sheet of a transparent or translucent film, commonly referred to as a film base. Common film base materials for photographic elements are cellulose triacetate and poly(ethylene terephthalate). These materials have properties which render them suitable for photographic applications. More recently it has been proposed to use poly(ethylene naphthalate) as a film base for photographic elements which are intended to be used in a cartridge of reduced diameter which requires rolling the film more tightly than previously. While conventional 35 mm film spools have diameters of about 11 mm, spools for proposed film cartridges have diameters as low as 7 mm, or lower. This is discussed in U.S. Pat. Nos. 5,294,473 and 5,368,997, which suggest that poly(ethylene naphthalate) has higher stiffness and lower propensity to take up core-set than either cellulose triacetate or poly(ethylene terephthalate.)

In order to realize the curl and core-set advantages of films made from poly(ethylene naphthalate), it is necessary to anneal the film at elevated temperatures for substantial periods of time. Even then, the core-set and curl characteristics are not as good as would be desired.

Accordingly, it would be desirable to provide a film base with improved physical properties. In particular it would be desirable to have a film base that has a lower propensity to curl and take up core-set while retaining adequate stiffness and tear strength. It also would be desirable to have such a film base which can be annealed using milder conditions.

SUMMARY OF THE INVENTION

We have found that a novel blend of poly(ethylene naphthalate) and a poly(ether imide) provides a film base with a number of useful properties which makes it particularly advantageous for photographic films.

In one aspect, the present invention is a photographic film base comprising a miscible blend of from 70 to 95 weight percent poly(ethylene naphthalate) and from 30 to 5 weight percent of a poly(ether imide).

In another aspect the present invention is a silver halide photographic element comprising a film base bearing at least one photographic layer, the film base comprising a miscible blend of from 70 to 95 weight percent poly(ethylene naphthalate) and from 30 to 5 weight percent of a poly(ether imide).

The present invention provides a film base that has desirable properties for use in photographic elements. These include low core-set, low post-process curl, good stiffness and good tear strength. In addition, these properties can be obtained without the need for annealing or by annealing for shorter times. Film base of this invention has core-set properties which permits its use in small diameter cartridges, for example, diameters in the range of 3 to 12.5 mm.

DETAILED DESCRIPTION OF THE INVENTION

Poly(ethylene naphthalate), sometimes abbreviated as PEN, previously has been used as a support for magnetic recording and playback tapes and had been proposed for use as a support for photographic film, for example in U.S. Pat. No. 4,141,735, U.S. Pat. No. 5,294,473 and U.S. Pat. No. 5,368,997. The '473 and '997 patents broadly describe copolyesters with PEN and blends of PEN with other polymers, but not with a poly(ether imide). The PEN used in the polymer blend of this invention can be the same polymer as described in this prior art, such as U.S. Pat. No. 5,368,997, the disclosure of which is incorporated herein by reference. Preferably it is poly(ethylene-2,6-naphthalate).

The PEN used in the polymer blends of this invention preferably have molecular weights represented by inherent viscosities in the range of 0.5 to 0.9 dl/gm. (Inherent viscosity is measured in a Ubbelhode capillary viscometer (Schott Gerate 536-13) at 25° C. and at a polymer concentration of 0.25 g/dL in a 50/50 mixture by weight of pentafluorophenol and 1,2,4-trichlorobenzene.) The PEN used in the polymer blends of this invention preferably has a glass transition temperature (Tg), above about 118° C.

Poly(ether imide), sometimes abbreviated as PEI, is the condensation product of a bis(etherdianhydride) and an organic diamine. Its synthesis, structure and use are described in U.S. Pat. Nos. 3,803,085, 3,847,867, 3,905,942, 4,011,198 and 4,293,684. The particular PEI used in the polymer blends of this invention can be as described in this prior art, such as U.S. Pat. No. 3,847,867, the disclosure of which is incorporated herein by reference. A preferred PEI is one in which the bis(etherdianhydride) is 2,2-bis[4-(2,3-dicarboxyphenoxy)phenyl]propane dianhydride (also known as Bisphenol A dianhydride) and the organic diamine is m-phenylene diamine.

Preferably, the PEI has a molecular weight represented by a melt viscosity in the range of $10^3$ to $10^5$ poise. Melt viscosity is measured according to the following procedure: A sample of the PEI in pellet form is dried under vacuum at 150° C. for 10 hrs. The dried sample is loaded into a parallel disk (25 mm diameter) fixture of a Rheometrics System IV® rheometer (manufactured by Rheometrics, Inc., Possumtown Rd., Piscataway, N.J. 08854) and its temperature is raised to 305° C. The viscosity of the melt is determined by shearing the resin at a constant oscillating frequency of 1 rad/s.

The PEI used in this invention preferably has a glass transition temperature (Tg) which is above 150° C. In addition, the PEI should be miscible with the PEN. By miscible is meant that the blend of the two polymers has a single glass transition temperature (Tg) and that a photographic film base made from the blend is clear. The PEI is available commercially from the General Electric Company, One Plastics Ave., Pittsfield, Mass. 01201, under the Ultem® trade name. Representative grades are Ultem 1000® and Ultem 1010®.

Blending of PEI with polyesters, such as PET and PEN is broadly described in U.S. Pat. No. 4,141,927 and Research Disclosure, November 1987, Item 28338, pages 677–8. (Research Disclosure is published by Kenneth Mason Publications, Ltd., Dudley Annex, 12a North Street, Emsworth, Hampshire P010 7DQ, ENGLAND.) These patents and publication do not describe the blends of this invention or suggest that they would be suitable for use as a photographic film base. Nor does any of this art suggest that blending PEI with PEN would have any influence on the core-set and post-process curl characteristics of a film base prepared from the blend, let alone suggest that such a blend would provide a film base in which these characteristics were improved.

The blends of this invention preferably have the following physical characteristics: a Tg of greater than 125° C.; a tensile modulus greater than 350 Kg/mm$^2$; light transmission greater than 80%; and haze less than 3%. The way in which these characteristics are determined is described in the Examples, infra.

While the relative proportions of PEN and PEI may vary somewhat with variation in the particular PEI employed, as well as with the presence of other components in the blend, preferred proportions of PEN and PEI in the blends of this invention are from 70 to 95 weight percent PEN and from 5 to 30 weight percent of PEI. When the proportion of PEI is increased, we have found that the tensile modulus is decreased, the crystallinity of the blend is lowered and a sheet formed from the blend becomes difficult to stretch. When the proportion of PEI is decreased below the said range, we have found that the improvement in physical performance of the blend becomes insignificant. Preferably the proportion of PEI is between 10 and 20 percent by weight. Most preferably the proportion of PEI is between 12 and 17 percent by weight. These are the preferred proportions for PEI prepared from bisphenol A dianhydride and m-phenylene diamine.

The polymer blend can be prepared by combining PEN and PEI using compounding techniques known to those skilled in the art. Film base is prepared from the polymer blend by techniques known to those skilled in the art. These techniques are described in detail in Schrader U.S. Pat. No. 4,141,735, the disclosure of which is incorporated herein by reference. A film base is understood to be a planar sheet having a thickness in the range of 50 to 200μm, preferably a thickness of 70 to 110μm.

In a typical operation, the film base is formed by extruding the polymer blend at a temperature of 290° to 320° C. through a sheeting die and casting the molten sheet on a chill roll at temperature of 60° to 120° C. The cast sheet is then stretched biaxially to from 2 to 5 times its initial lateral dimensions. Stretching can be at a temperature in the range of from 130° to 170° C. Biaxial stretching can be sequential or simultaneous. After stretching the film base is heatset at a temperature in the range of 200° to 250° C. for time in the range of 0.1 to 10 sec. If the film base is to be annealed, it can be annealed at a temperature in the range of from 50° C. up to the $T_g$ of the polymer blend for a time in the range of 0.1 to 1000 hours. Film base with core-set characteristics useful for small diameter film cartridges can be obtained with preferred blends of this invention by annealing at temperatures of between about 90° and 125° C. for times of 6 to 48 hrs.

Film base prepared from polymer blends of this invention can contain other components commonly found in film supports for photographic elements. These include dyes, lubricants and particles of organic and inorganic materials such as glass beads. These are described in more detail in Research Disclosure, Feb. 1995, Item 37038, pages 79–114.

Film base prepared from polymer blends of this invention can bear layers commonly found on film supports used for photographic elements. These include magnetic recording layers, subbing layers between other layers and the support, photosensitive layers, interlayers and overcoat layers, as are commonly found in photographic elements. These layers can be applied by techniques known in the art and described in the references cited in Research Disclosure Item 37038 cited above.

Magnetic recording layers that can be used in photographic element of this invention are described in U.S. Pat. Nos. 3,782,947, 4,279,945, 5,147,768, 5,252,441, 5,254,449, 5,395,743, 5,397,826, 5,413,902, 5,427,900, 5,432,050, 5,434,037, 5,436,120, in Research Disclosure November 1992, Item 34390, pages 869 et seq., and in Hatsumei Kyoukai Gihou No 94–6023, published Mar. 15, 1994 by Hatsumei Kyoukai, Japan.

Photographic elements of this invention can have the structures and components shown on Research Disclosure Item 37038 cited above and can be imagewise exposed and processed using known techniques and compositions, including those described in the Research Disclosure Item 37038 cited above.

The following examples further illustrate this invention.

EXAMPLE 1:

Sheets formed from PEN and blends of PEN and PEI in the proportions shown in Table 1, below, were prepared and evaluated, as follows:

Pure poly(ethylene-2,6-naphthalate), identified as Composition 1, having an inherent viscosity of 0.69 dL/g, was blended in a twin screw extruder with 20 weight percent of a poly(ether imide) condensation product of bisphenol A dianhydride and m-phenylene diamine (sold as Ultem® 1010 by General Electric Company, One Plastics Ave., Pittsfield, Mass. 01201) to form a blend identified as Composition A. From Composition A were formed two other blends, identified as Composition B and Composition C, by dry blending Composition A with Composition 1 in ratios of 75:25 and 50:50, respectively.

The four compositions were extruded through a sheeting die and cast on a chill roll to a thickness of 1.1 mm. The cast sheets were stretched biaxially at a ratio of 3.5×3.5 and then heat set at temperatures shown in Table 1 to provide film base useful in this invention.

The resulting films were evaluated for core-set and post-process curl, tensile properties and optical properties, as described below. The results are reported in Table 2.

Glass Transition Temperature: Samples of each composition were heated in a differential scanning calorimeter (a 990 Thermal Analyzer sold by DuPont, Wilmington, Del.) from about 20° C. to 300° C. at 10° C./min, then quenched back to 20° C. and finally reheated to 300° C. at 10° C./min. The Tg reported is the mid-point temperature in the first transition of the second thermogram.

Tensile Properties: Five lengthwise and five widthwise strips 150 mm×15 mm were cut from each of the films prepared above. A Sintech tensile tester (available from Sintech Inc. 378 Page St., Stoughton, Mass. 02072) was used to measure representative tensile properties in accordance with ASTM D882. The properties measured (and the units in which they are reported in Table 2) are: tensile modulus (Kg/mm$^2$), yield stress (Kg/mm$^2$), break stress (Kg/mm$^2$) and break elongation (%).

Tear Strength: Five lengthwise and five widthwide strips 75 mm×25 mm were cut from each of the film bases prepared above and tested in accordance with ASTM D1938. Tear strength is reported as the force (g) needed to propagate the tear.

Optical Properties: Both haze and light transmission were measured using a BYK-Gardner XL-211 hazemeter (available from BYK-Gardner Inc., 2435 Linden La., Silver Springs, Md. 20910) according to the procedure of ASTM D1003-61.

Core-Set (CS): For each of the tests shown below, six lengthwise strips 150 mm×35 mm were cut from each of the films prepared above. The strips were conditioned at 21° C./50% relative humidity overnight and their curl was measured according to Test Method A in ANSI P41.29-1985. The results are reported in terms of 1/R, $m^{-1}$, where R is the radius of curvature of the curled film.

The following winding conditions were used in the core-set tests:

CSI: the film base was held at 80° C./50% RH for 2 hrs on a 7 mm diameter core.

CSII: the film base was held at 49° C./50% RH for 24 hrs on a 12.5 mm diameter core.

The same core-set measurements were repeated for samples of the films that had been annealed at 100° C. for 24 hrs.

Post-Process Curl (PPC): The samples that had been submitted to the core-set tests were soaked in water at 38° C. for 15 min and then dried at 50° C. for 3 min with a 50 g weight hung from each strip. After the weight was removed the strips were allowed to equilibrate at 21° C./50% relative humidity for 16 hrs. and then curl was measured in the same way as had been done to determine core-set.

TABLE 1

| | Film Preparation | | | |
|---|---|---|---|---|
| Film from | Comp. 1 | Comp. A | Comp. B | Comp. C |
| Wt % PEN | 100 | 80 | 85 | 90 |
| Wt % PEI | 0 | 20 | 15 | 10 |
| Stretch Temp. (°C.) | 146 | 150 | 145 | 141 |
| Heatset Temp. (°C.) | 175 | 170 | 170 | 170 |
| Stretch Ratios | 3.5 × 3.5 | 3.5 × 3.5 | 3.5 × 3.5 | 3.5 × 3.5 |

TABLE 2

| | Film Properties | | | |
|---|---|---|---|---|
| Film from | Comp. 1 | Comp. A | Comp. B | Comp. C |
| Tg (°C.) | 119 | 130 | 126 | 123 |
| Thickness (μm) | 70 | 75 | 80 | 90 |
| Tensile Modulus (Kg/mm²) | 580 | 485 | 520 | 530 |
| Yield Stress (Kg/mm²) | 13 | 12 | 13 | 13 |
| Break Stress (Kg/mm²) | 19 | 14 | 16 | 17 |
| Break Elong. (%) | 76 | 73 | 74 | 73 |
| Tear Strength (g) | 47 | 25 | 38 | 45 |
| Haze (%) | 0.9 | 1.1 | 0.6 | 0.7 |
| Light Trans. (%) | 84 | 84 | 85 | 84 |
| Core-Set and Post-Process Curl | | | | |
| Unannealed | | | | |
| CSI (1/m) | 167 | 119 | 138 | 156 |
| PPCI (1/m) | 121 | 90 | 98 | 118 |
| CSII (1/m) | 69 | 49 | 60 | 68 |
| PPCII (1/m) | 38 | 23 | 30 | 32 |
| Annealed | | | | |
| CSI (1/m) | 87 | 63 | 69 | 77 |

TABLE 2-continued

| | Film Properties | | | |
|---|---|---|---|---|
| Film from | Comp. 1 | Comp. A | Comp. B | Comp. C |
| PPCI (1/m) | 39 | 24 | 28 | 30 |
| CSII (1/m) | 37 | 30 | 35 | 35 |
| PPCII (1/m) | 12 | 8 | 11 | 11 |

From the results reported in Table 2, it can be seen that improvements in core-set and post-process curl are obtained while retaining high tensile modulus, good tear strength and good optical properties.

The invention has been described by reference to preferred embodiments, but it will be understood that changes can be made to the embodiments specifically described herein within the spirit and scope of the invention.

What is claimed is:

1. A silver halide photographic element comprising a film base bearing at least one photographic layer, the film base comprising a miscible blend of from 70 to 95 weight percent poly(ethylene naphthalate) and from 30 to 5 weight percent of a poly(ether imide).

2. A silver halide photographic element of claim 1, wherein the film base comprises a miscible blend of from 80 to 90 weight percent poly(ethylene naphthalate) and from 20 to 10 weight percent of a poly(ether imide).

3. A silver halide photographic element of claim 1, wherein the film base comprises a miscible blend of from 83 to 88 weight percent poly(ethylene naphthalate) and from 17 to 12 weight percent of a poly(ether imide).

4. A silver halide photographic element of claim 1, wherein the poly(ether imide) is a condensation polymer of 2,2-bis[4-(2,3-dicarboxyphenoxy)phenyl] propane dianhydride and m-phenylene diamine and the poly(ethylene naphthalate) is poly(ethylene-2,6-naphthalate).

5. A photographic film base of claim 4, wherein the polymer blend has a Tg of greater than 125° C. and a tensile modulus of greater than 350 Kg/mm².

6. A silver halide photographic element of claim 1, wherein the film base has been annealed at a temperature in the range of from 50° C. up to the $T_g$ of the polymer blend for a time in the range of 0.1 to 1000 hours.

7. A photographic element of claim 1 wherein the film base comprises a blend of from 83 to 88 weight percent poly(ethylene-2,6-naphthalate) and from 17 to 12 weight percent of a poly(ether imide) condensation polymer of 2,2-bis[4-(2,3-dicarboxyphenoxy)phenyl] propane dianhydride and m-phenylene diamine.

8. A photographic element of claim 1, wherein the film base bears a magnetic recording layer.

9. A photographic element of claim 1, wherein the film base has light transmission of greater than 80% and haze of less than 3%.

* * * * *